United States Patent [19]

Wachspress

[11] Patent Number: 4,874,346

[45] Date of Patent: Oct. 17, 1989

[54] FREE FLYING MAGNETIC LEVITATOR

[76] Inventor: How Wachspress, P.O. Box 99141, San Francisco, Calif. 94109

[21] Appl. No.: 141,566

[22] Filed: Jan. 6, 1988

[51] Int. Cl.[4] ..... A63H 33/26

[52] U.S. Cl. ..... 446/484; 310/90.5

[58] Field of Search ..... 310/90.5, 52, 68 R; 40/426; 446/129, 133, 484; 335/306

[56] References Cited

U.S. PATENT DOCUMENTS

| | | | |
|---|---|---|---|
| 2,377,175 | 5/1945 | Peer | 40/426 |
| 4,585,282 | 4/1986 | Bosley | 310/90.5 |
| 4,644,205 | 2/1987 | Sudo | 310/90.5 |

FOREIGN PATENT DOCUMENTS

| | | | |
|---|---|---|---|
| 0231109 | 8/1987 | European Pat. Off. | 310/90.5 |
| 2823753 | 12/1979 | Fed. Rep. of Germany | 446/133 |
| 0073223 | 5/1982 | Japan | 310/90.5 |
| 1069673 | 5/1967 | United Kingdom | 310/90.5 |

OTHER PUBLICATIONS

Electromagnetic Jet-Propulsion in the Direction of Current Flow, by P. Graneu; "Nature", pp. 311, 312; 1/28/82.

A Flying Superconducting Magnet & Cryostat for Magnetic Suspension in Wind-Tunnel Magnets, by C. Britcher et al.; "Cryogenics", pp. 185-189; 4/84.

"A Guide to Superconductivity"; Fishblock, McDonald, Longon, England; 1969.

*Primary Examiner*—R. Skudy

*Attorney, Agent, or Firm*—Alvin E. Hendricson

[57] ABSTRACT

A free flying magnetic levitator that is self stabilized and fully maneuverable for magnetic structure establishing an odd number of poles for interaction with another magnetic field having an even number of poles to produce linear motion instead of rotation without a guideway. Longitudinally wound coils produce the odd pole magnetic field for maximizing coupling with an even pole field such as the magentic field of the earth.

13 Claims, 6 Drawing Sheets

FREE FLYING MAGNETIC LEVITATOR

BACKGROUND OF INVENTION

It is known in the art of magnetics that magnets and magnetic materials can exert forces of attraction and/or repulsion between each other and various magnetomechanical devices are known, including flying systems such as levitating trains. These levitators require some form of linear guideway to provide lateral stability and directional guidance. Without such a guideway the interaction between opposing magnet systems would terminate linear motion. The levitator would no longer have suspension and thrust, and would rotate to a static rest. A novel levitator is herein provided that requires not guideway, is free flying, self stabilized and fully maneuverable.

With regard to movement of the levitator hereof in space, it is noted that the earth's magnetic field has substantially parallel lines of force over any limited distance and the present invention provides for establishing an interacting tripole magnetic field by forming the turns of magnetic fields thereof perpendicularly to the circumference of the winding. With such winds, interaction with the earth's magnetic field, for example, results from coupling primarily through the vector potential field of the levitator windings and obeys Ampere's longitudinal force law to indeed produce substantial thrust in the "weak" magnetic field of the earth.

SUMMARY OF THE INVENTION

The present invention provides a levitator or flight unit incorporating a number of magnets having an odd number of poles that is controllably movable in an exterior magnetic field and which is herein embodied as a toy having a tethered flight unit controllably movable in a magnetic field. The term field generator is herein employed to define a principal magnetic field source that the levitator interacts with.

It is known that a magnet having three poles may be formed by physically connecting a pair of dipole magnets together with like poles contacting each other. This structure may then have, for example, north poles at each end and a south pole at the center. It has been commented by at least one researcher that such structure has no useful purpose. It is possible, however, to combine tripole magnets, for example, in such a way that a net force is exerted thereon by an external magnetic field to the end of moving the combination by magnetic forces and in fact to support and move the combination in the space by such forces. A simple combination of tripole electromagnetics is herein controllably energized to not only levitate the combination in a magnetic field, but also to controllably move the combination in the field.

Considering now magnetic forces and interactions as an aid to understanding the present invention, it is first noted that magnetomechanical interactions are the direct result of polar relationships. Conventional magnetomechanical machines have an even number of active poles and can be explained by elementary dipole-dipole interactions. It is known that opposite poles attract each other and like poles repel. Two unrestrained dipoles may exhibit some repulsion temporarily, but will not remain in stable opposition, as they inevitably rotate and attract each other. Single isolated magnetic pole have been hypothicated as elementary particles but no single pole magnets have been adequately confirmed. A hypothetical isolated magnetic pole would be attracted toward another opposite monopole and repelled from a like monopole along a straight trajectory. A monopole would be attracted to one pole of the dipole and repelled by the other pole and would follow a curvilinear trajectory. A first dipole magnet can be made to move across the field lines of a second if the field of the first magnet is tapered, although a tapered dipole will also rotate as it cuts across the field and will come to rest when in line with the other field's force lines.

A three pole magnet, as employed in the present invention, exhibits many of the characteristics of a monopole. If the flux in both halves of a tripole are equal, the opposite rotational moments thereof in a magnetic field will balance each other. However, in order to have linear motion between a tripole and a dipole, the inner pole and outer poles of the tripole must have different effective strengths and they should couple to the dipole field with different efficiencies. In essence, there should be weaker and stronger poles, i.e., a pole differential. Winding an electromagnetic tripole along two opposite horn or cone sections with their throats meeting in the middle creates a greater magnetic flux density in the middle pole because there are more turns per ampere of current flow in the middle pole compared to the outer poles. Also, the inner and outer poles operate at different characteristic impedance (mostly reluctance and inductive reactance) causing a differential of coupling efficiencies to the external dipole field. Without these acting on the tripole they would balance each other and there would be no motion.

Another major factor determining the overall magnetomechanical performance of the dipole-tripole interactions and all even pole-even pole, odd pole-odd pole interactions is the overall impedance matching of opposing systems. In most magnetomechanical systems the gap between moving elements is very small the loss of efficiency by poor impedance matching is insignificant so there has been little investigation of the problem. However, a free flying magnetic levitator generator system, with the flux in the medium between them, where the gap between moving elements can be very large impedance matching becomes important. A closer impedance match is a function of the size, shape and materials of the opposing systems. In the case of an electromagnet tripole interacting with a permanent magnet dipole, it is proposed that a coating of the winding wire of the tripole with materials havig a magnetic permeability larger than the wire but smaller than the permanent magnet dipole would improve coupling efficiency and that such permeability should be close to the permeability of the medium between both systems.

The use of coating to improve the performance of a system is common practice in other technologies, although the correlations to magnetic levitators have been evidenced only by rudimentary demonstration. The electromagnet tripole is not limited to employing slowly varying direct electrical currents, but can employ all types of modulated alternating currents, hence the levitator becomes a cross between a motor and antenna. The permanent magnet dipole has certain characteristic electromagnetic resonances and a dynamic antenna motor tripole serving as a levitator will interact dynamically with the dipole as well as statistically; however, such theory and application is still only rudimentarily developed. However, the static odd pole-even pole interactions of novel value here are more clearly demonstrated and explained above.

Free flying magnetic levitators can be configured from two tripoles disposed perpendicularly to each other, as well as other combinations of tripoles, five pole magnets and other odd pole combinations. A simple magnetic levitator is a full embellishment of Coulombs law for magnetomechanical systems:

$$F_{FL} = KC_E\phi_F\phi_L = u_m r^2$$

Where F=force between the levitator and the filed generator, C=coupling efficiency, $\phi_F$=magnetic flux of the field generator, $\phi_L$ C=magnetic flux of the levitator, $u_m$=permeability of the medium, r=distance between the levitator, and the filed generator, K=universal magnetic constant (for compatability of units). This law is applicable to all permanent and electromagnets operating as motors or generators.

BRIEF DESCRIPTION OF FIGURES

The present invention is illustrated as to preferred embodiments in the accompanying drawings wherein.

DESCRIPTION OF PREFERRED EMBODIMENTS

Figure 1:
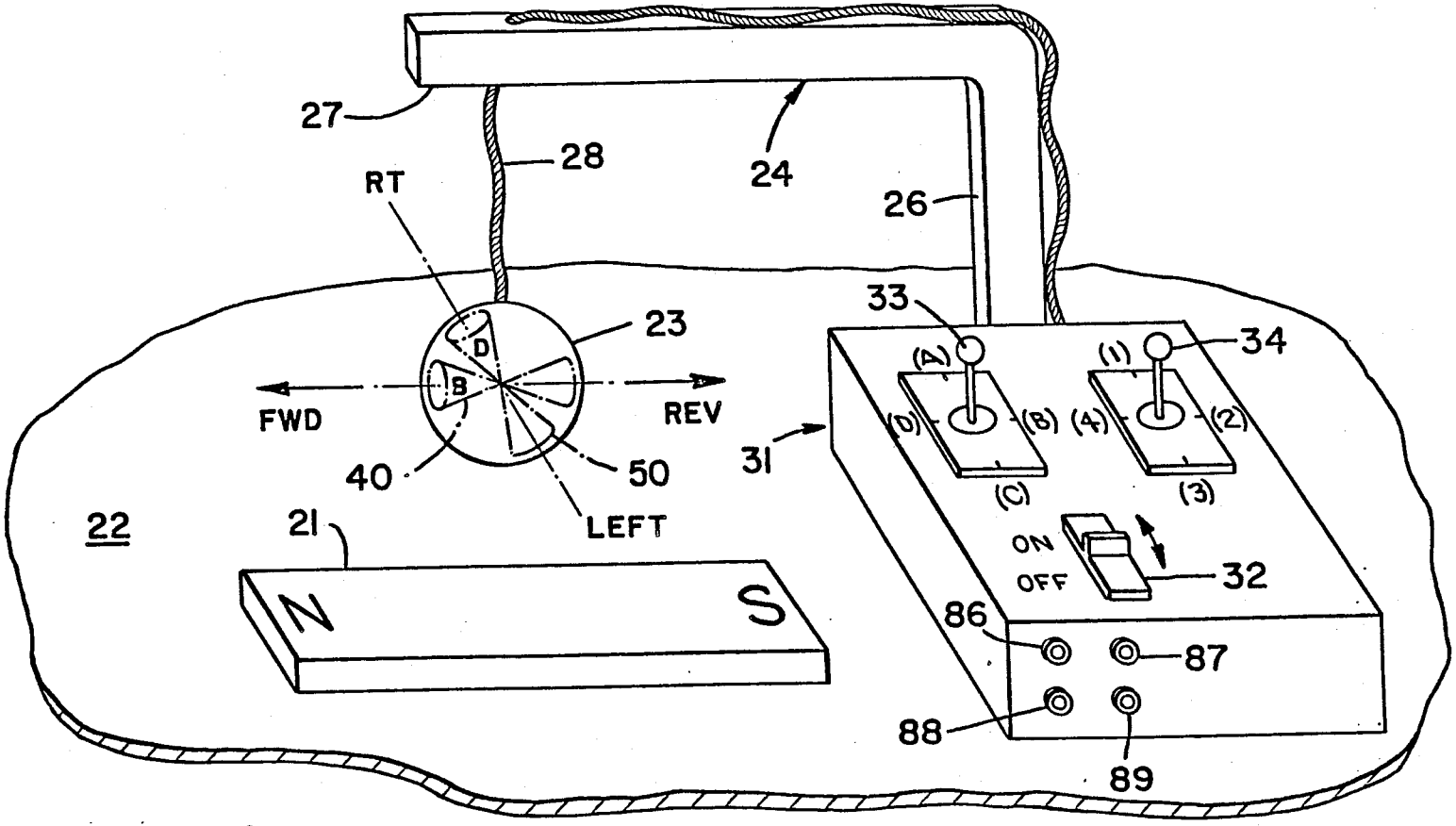
FIG. 1 is a schematic representation of controllable levitating toy.

The present invention may be embodied as a toy such as illustrated in FIG. 1 of the drawings wherein a bar magnet 21 is shown to be mounted on a non magnetic and non conducting board or the like 22 and a tethered flight unit 23 is suspended from a support 24 above the magnet 21. This support 24 may have a vertical portion 26 extending upwardly from the board 22 and a generally horizontal arm 27 extending over the magnet with a tether 28 depending from an outer end of the arm 27 and secured to the flight unit 23 for normally supporting the latter above the magnet 21. There is also provided a control unit 31 which may be also mounted on the board 22. The flight unit 23 is electrically energized through the tether 28 as further described below, and thus this tether 28 extends into connection with the control unit 31 which may contain one or more electrical batteries for energizing later described elements of the flight unit 23. The control unit is shown in the illustrated embodiment to include an on/off switch 32 and a pair of joy stick controls or joy sticks 33 and 34. These joy sticks 33 and 34 are shown to be adapted for movement in the manner of an airplane stick toward and intermediate to the four quadrant positions of each which are indicated for stick 33 by the letters A, B, C, and D and for the joy stick 34 as numerals (1), (2), (3) and (4).

The flight unit 23 of the present invention as illustrated in FIG. 1 may be exteriorly comprised as a ping pong ball or the like and interiorly thereof there may be provided a pair of orthogonally disposed tripole electromagnets adapted for controlled energization from the control unit 31 by the joy sticks 33 and 34. Energization of the flight unit 23 by the switch 32 in the control unit 31 will cause the magnetic fields about the flight unit 23 to interact with the magnetic fields above the bar magnet 21 and appropriate operation of the control unit will cause the flight unit 23 to levitate, i.e., to rise upwardly from the board 22 above the magnet 21 so as to release tension on the depending tether 28, as indicated in FIG. 1. The flight unit 23 may be formed so as to be stable in the fixed magnetic field of the magnet 21 and thus not rotate or to be thrown laterally out of this fixed magnetic field. Additionally, manipulation of the joy sticks of the control unit 32 may be employed to control movement of the flight unit 23 in the external magnetic field.

It will be appreciated that the manner of energizing the flight unit 23 may be varied and the simplest manner appears to be the provision of electrical connection thereto by a tether 28, as illustrated. It is, however, also possible to incorporate a power supply and control means within the flight unit 23 which can them be readily radio controlled without the necessity of employing a tether or electrical connection to the flight unit. Certain aspects of the foregoing are further discussed below.

Figure 2A:
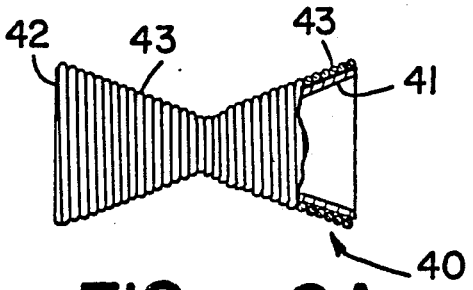
FIG. 2A is a side view of one tripole electromagnet of the flight unit of the toy of FIG. 1.
Figure 2B:
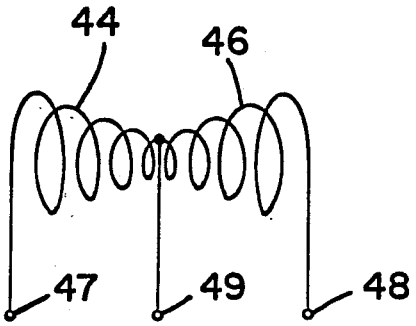
FIG. 2B is an electrical diagram of the tripole of FIG. 2A.

Considering now somewhat further, the flight unit 23 and, in particular, the operating portions thereof, reference is made to FIGS. 2A and 2B. In FIG. 2A there is illustrated a simple tripole electromagnet 40 which may be formed of a pair of small hollow truncated paper cones 41 and 42 connected together at the truncations thereof and externally wound with small copper wire 43. The wire 43 is insulated and forms a substantial plurality of turns on the exterior of the cones 41 and 42. The electrical equivalent of the foregoing is illustrated in FIG. 2B wherein there will be seen to be formed a first coil 44 having a large diameter at one end and a small diameter at the other end. Electrical connections are provided at 47 and 49 to the outer or large ends of the coils 44 and 46 and a common connection 49 is made to the joinder of the small ends of the coils 44 and 47. It will be appreciated that a current passing through a coil produces a magnetic field about the coil with the direction thereof being dependent upon the directions of current flow and the flux thereof proportional to the product of the current times the number of turns of the coil. In the simple configuration of FIG. 2B, for example, current flowing from the terminals 47 and 49 to the common terminal 49 produce a magnetic field having like poles at the outer or larger ends of the coils and a pole of opposite polarity at the center or joinder of the coils. Additionally, it will be noted that forming the coils in the manner described produces more turns at the center or joinder of the coils so as to produce a more intense field thereat.

Control over the magnetic field or fields about the tripole electromagnet 40 illustrated in FIG. 2A and 2B may be readily accomplished by controlling the current flowig through the coils 44 and 46 and thus, for example, reversing the polarity of current flow will reverse the polarity of the magnetic field about the entire unit. Varying the current flow to one coil with respect to the other coil will thus vary the field intensity about one of the coils with respect to the other. These capabilities are of particular interest and importance in the present invention as further described below.

Figure 3:
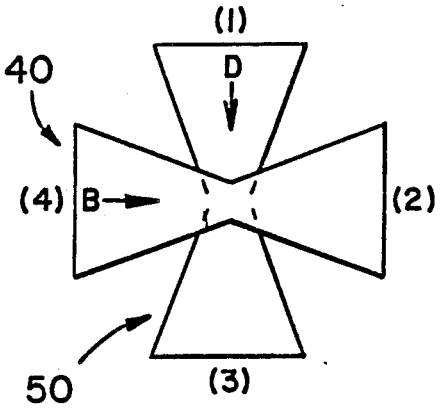
FIG. 3 is a plan view of the pair of tripole electromagnets of the flight unit of FIG. 1.

The simple tripole electromagnet illustrated in FIGS. 2A and **2*b* and briefly described above may be employed as a building block for a variety of different flight units, for example, and in this respect reference is made to FIG. 3. A pair of tripole electromagnets or units 40 and 50 are shown to be disposesd in orthogonal relationship with the truncated conical portions of each being contiguous and in the illustrated embodiment the unit 40 overlies the unit 50. This simple configuration may, in fact, be employed as the interior of the flight unit 23 disposed, for example, within the ping pong ball forming the shell of this flight unit. It will be appreciated that a coil is formed on each of the truncated cones of each of the units 40 and 50. In order to relate the energization of the tripole electromagnets and individual coils thereof to the control unit 31, there are provided certain notations on the illustration of FIG. 3 which will be seen to relate to like notations in FIG. 1. The triple electromagnets 40 and 50** may, for example, be glued to the interior of the ping pong ball or shell of the flight unit of if contacting each other may be glued together.

Figure 4:
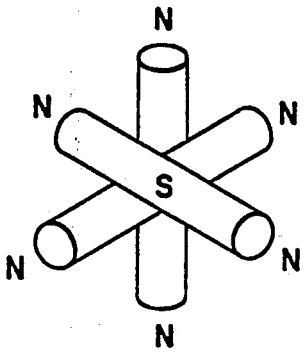
FIG. 4 is a schematic illustration of a three tripole magnet arrangement.
Figure 5:
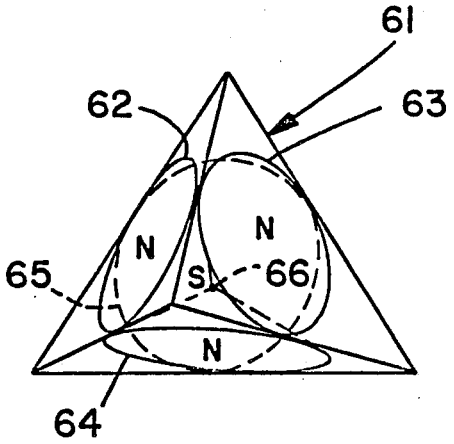
FIG. 5 is a schematic representation of a pentapole magnet arrangement.

Before proceeding with a further description of the illustrated embodiment of the present invention described above, it is noted that various combinations of tripole or odd pole magnets may be employed to produce a self-stabilized and fully maneuverable levitator in accordance with the present invention. It is also not necessary to provide windings on truncated cones and they may have a cylindrical shape. There is, for example, illustrated in FIG. 4, an embodiment of the present invention employing three tripoles which are mutually perpendicular with the centers thereof disposed as close together as possible. Further arrangement of interest and possibly substantial importance is a pentapole configuration wherein four cones are disposed with the large faces thereof on separate surfaces of a tetrahedron and the small ends thereof joined together at the center thereof. Such an arrangement is schematically illustrated in FIG. 5, wherein a tetrahedron 61 is illustrated with one face thereof comprising the plane of the drawing and the other three faces extending upwardly therefrom toward the viewer. Coils 62, 63, 64 and 65 are shown to have the large ends thereof disposed on separate surfaces of the tetrahedron 61 and the small ends meeting at the common point 66 at the center of the tetrahedron. These coils may, for example, be energized to establish north poles at the large ends or faces thereof, as indicated, and a south pole at the common small ends thereof. This particular configuration is advantageous for particular applications and it is noted that the tetrahedron 61 is only illustrated in FIG. 5 to identify the orientation of the coils and need not exist in a physical structure. More complex combinations of odd pole magnet configurations are also provided such as heptapole wherein six pole sections are provided with a common small end and the large ends thereof disposed on separate faces of a cube, and also octahedron and higher order arrangements.

Figure 6:
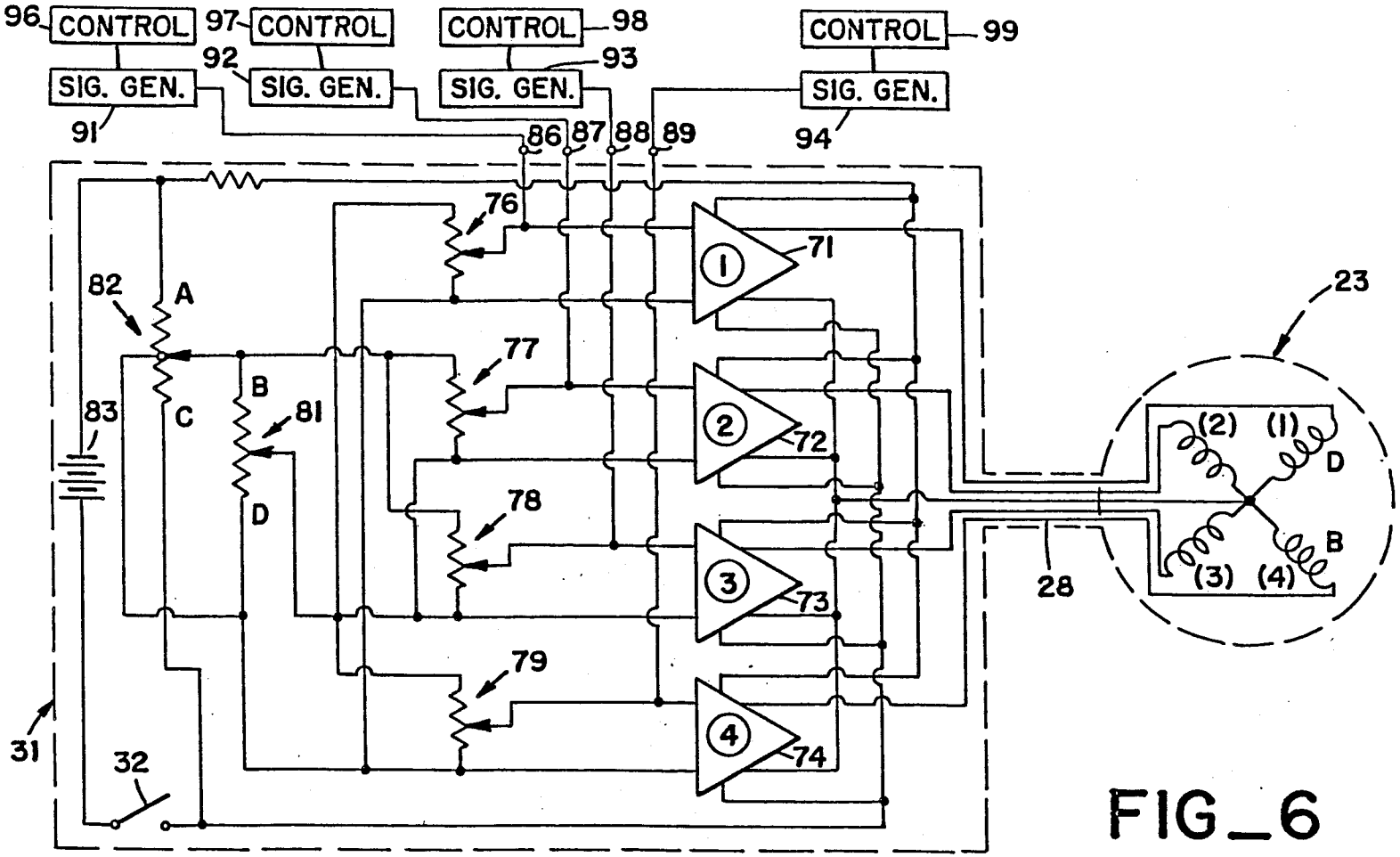
FIG. 6 is a schematic diagram of the control unit of FIG. 1 with flight unit and tether.

Considering now the control unit 31 of the embodiment of th e present invention illustrated in FIG. 1 of the drawings, reference is made to FIG. 6 wherein the flight unit 23 is schematically illustrated to be connected by the tether 28 to circuitry of the control unit. The flight unit 23 is shown to include a pair of tripole electromagnets B and D disposed perpendicularly to each other and each having a pair of magnet windings with common connection at the center thereof. The windings, for convenience, are denominated as (1), (2), (3) and (4) corresponding to the numbering employed for the quadrants of the joy stick 34 of the control unit. The control unit provides for individually energizing the coils of the flight unit and to this end there are provided four amplifiers 71, 72, 73, and 74. It will be seen that amplifier 71 is connected across coil 91) with the remaining amplifiers connected across successive coils in like manner. Input voltages to the amplifiers 71 through 74 are individually controlled by the potentiometers 76, 77, 78, and 79, respectively, with the movable contacts thereof being operated by the joy stick 34 so that the current flow to each separate coil of the flight unit may be individually controlled.

Provision is also made in the control unit for varying the energization of one tripole magnet with respect to the other and this is accomplished by a potentiometer 81 disposed on the power supply side of the potentiometers 76 through 79. This potentiometer 81 has a movable contract thereof connected to one side of each of the potentiometers 76 through 79 and thus with a voltage applied across the potentiometer 81, movement of the movable contact will increase energization of one of the tripoles while decreasing energization of the other. In FIG. 6 the ends of the potentiometer 81 are identified as B and D corresponding to the designation of tripoles in the flight unit. Thus movement of the movable contact of the potentiometer 81 toward the upper end, as illustrated, will increase the energization of tripole B while decreasing the energization of tripole D, and vice versa.

Provision is also made herein for reversing the polarity of energization of the tripoles and this is shown to be accomplished by the provision of a further potentiometer 82 connected across a power supply such as 6-volt battery 83 through the on/off switch 32. This potentiometer 82 is center tapped and this center tapped is connected to the lower end of the potentiometer 81, denominated by the letter D, with a movable contact of the potentiometer being connected to the upper end of the potentiometer 81, denominated by the letter B. It will be appreciated that adjustment of the position of the movable contact of the potentiometer 82 will thus serve to adjust overall energization of the two tripoles and also to reverse the polarity of energization of them. The letters A, B, C and D of FIG. 6 correspond to the quadrants similarly denominated for the joy stick 33 in FIG. 1.

The present invention may also provide for modulating the currents passed through the coils of the tripoles of the flight unit by external means via jacks 86–89. This illustrated in block diagram in FIG. 6 by signal generators 91, 92, 93 and 94 connected to the inputs of amplifiers 71, 72, 73 and 74, respectively, through jacks 86–89. Only single line connections are shown; however, it will be realized that modulating signals are applied across the input terminals of the amplifiers 71 through 74 at the dictates of the control elements 96 through 99, respectively.

Figure 7:
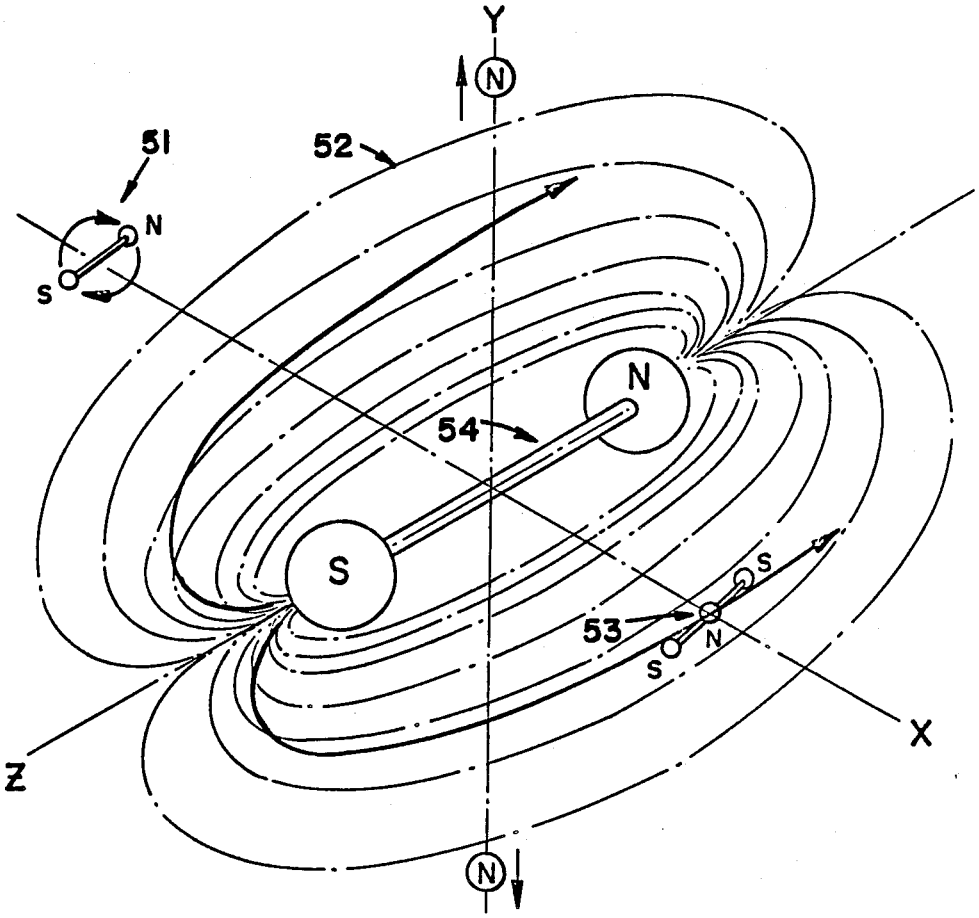
FIG. 7 is a diagramatic representation of magnetic fields and interactions thereof.

While the physical operation of the present invention is quite straightforward, an understanding of the reasons therefor may be best obtained by first considering certain magnetic relationships and interactions and in this respect reference is made to FIG. 7 of the drawings. A magnetic dipole 51, i.e., a magnet having a north and a south pole, when disposed in a external magnetic field 52, will rotate as indicated at the upper left of FIG. 7 into alignment with the field lines of the magnetic field 52 inasmuch as like poles repel and unlike poles attract. A hypothetical monopole is attracted toward a monopole of opposite polarity and repelled from a monopole of like polarity to travel in a straight line trajectory. A tripole magnet or tripole 52 disposed in an external magnetic field of a dipole 54 exhibits certain characteristics of a monopole magnet. If both halves of a tripole are of equal strength the opposite rotational moments thereof in an external magnetic field will balance each other so that no rotation occurs. Linear motion of a tripole in a dipole magnetic field may be obtained by having different efficiencies of coupling with the dipole field. A single tripole magnet 53 disposed in an external magnetic field 52 will travel along a curvilinear trajectory, as indicated by the heavy lines in FIG. 7. It is also noted that a tripole magnet may be oriented in line with or across lines of force of a field generator. In cross field orientation a tripole magnet will move in a curvilinear trajectory opposite to that of the in-line orientation.

Referring now again to FIG. 1 of the drawings, operation of the switch 32 to place same in the "on" position will energize the circuitry of the control unit 31. With the joy stick 33 vertical the movable contact of the potentiometer 82 will be in the position illustrated in FIG. 6 so that the coils of the flight unit 23 are not energized. Movement of the joy stick 33 forward or backward between A and C in FIG. 1 will cause the coils in the flight unit to be energized with one or the other polarity. Rotational movements of a tripole electromagnet or tripole are produced by causing one-half of the tripole to become weaker or stronger than the other half. As this pole section differential is increased the tripole acts more and more like a dipole, rotating through the path of least resistance into an alignment with the lines of force or the exterior or opposing magnetic field. In the present instance, it will be realized that the flight unit 23 is depending from the tether 28 in the magnetic field of the magnet 21. It will, of course, be appreciated that the flight unit will operate in any magnetic field, whether produced by a bar magnet, electromagnet or field generator of any type including the earth's magnetic field. Obviously the strength of the fields involved affect the magnitude of the effects produced. It is also noted that the gradients of the tapered poles begin to unbalance with the increased taper caused gradient differential making the tripole cut across the field generator force lines. The tripole acts partially like a tapered dipole and if one tripole in a dual tripole levitator, such as illustrated, is stronger overall than the other tripole, the strong tripole will act in effect as a bearing about which the weaker tripole can rotate.

Considering the joy stick controls, it is noted the pushing joy stick 34 from neutral position toward position (1) will nose down the levitator; pushing the joy stick toward position (3) will nose up the levitator; pushing the joy stick toward position (2) will move the levitator sideways to the right and pushing the joy stick toward position (4) will move the levitator sideways to the left. It is also noted that the flight unit properly energized there is a net upward thrust thereon from the interaction of the magnetic fields and this may be made sufficient to counteract the effect of gravity so that the flight unit in effect hovers and removes tension on the tether 28.

The other joy stick 33 may be operated by moving it from its neutral or vertical position A to cause the flight unit to move forward and moved toward position C to cause the flight unit to move backwards or reverse. Moving the joy stick 33 toward position B will make tripole B more powerful than tripole D and if tripole B is in line with the field generator force lines this will provide a bearing in effect to bank the levitator. Moving the joy stick 33 toward position D will make the tripole D more powerful than the tripole B and if tripole D is across the field generator force lines there will be provided a bearing in effect to nose the levitator up or down.

It wil be seen that the flight unit 23 may be controlled, not only to hover in a exterior magnetic field or the field of an exterior field generator also to make all of the motions possible with conventional flying devices such as an airplane. One operating the present invention may thus move the flight unit 23 about in the surrounding magnetic field generated in this circumstance by the bar magnet 21 acting as the external field generator. It will, of course, be appreciated that the controls of the control unit 31 may be set up in a variety of ways, possibly for example, by providing separate joy sticks for A–C and D–B. It will also be appreciated that the physical configuration of the exterior of the flight unit 23 is subject to wide variation and for some applications it may be of interest to form the flight unit with laterally extending wings, for example, in order that a user of the invention may fully appreciate the degree of control of the flight unit that is possible with the present invention.

Figure 8:
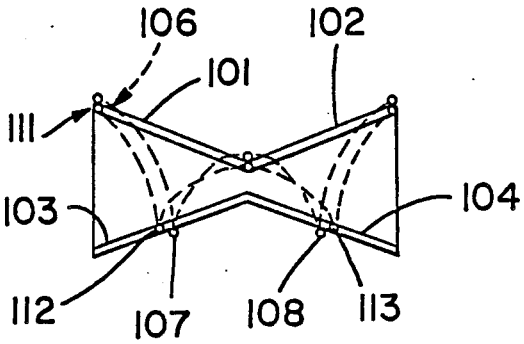
FIG. 8 is a partial schematic side view of another tripole magnet configuration.
Figure 9:
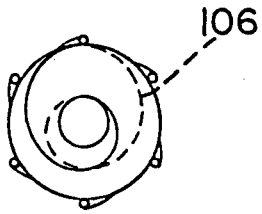
FIG. 9 is a schematic end view of a portion of the electromagnet configuration of FIG. 8.

As noted above, there are numerous modifications and variations of the present invention which are possible within the scope of this invention and, in this respect, reference is made to FIGS. 8 and 9 illustrating an alternative tripole arrangement that is particularly applicable for certain situations. As shown in FIG. 8, there are provided two exterior frusto-conical sections 101 and 102. Within this exterior structure, there is provided coaxial and like but smaller double horn combined frusto-conical sections 103 and 104. Upon the outer structure 101–102 there is provided a two-turn coil 106 having single turn coil sections 107 and 108 wound on the frusto-conical sections 101 and 102 respectively with the common center point at the joinder of these sections. Similarly there is wound an inner two-turn coil 111 upon the frusto-conical sections 103 and 104 and having coil sections 112 and 113 with a common center at the small coil section ends. Preferably there are provided six exterior coils similar to coil 106 and six interior coils like coil 111. These six coils are connected in electrical parallel.

The illustration of FIGS. 8 and 9 are not intended to show complete unit, but instead are provided for the purpose of illustrating one manner of forming a particular tripole magnet structure. Thus in FIG. 9, there is schematically or diagrammatically shown one coil 106 which will be seen to comprise a first inwardly spiraling portion of one turn and then by a dashed line in an outwardly spiraling single turn. With six coils being provided upon the structure the ends thereof would be space apart as indicated in FIG. 9. It will be appreciated that the inner coil windings such as coil 111 are wound in a similar manner.

The tripole arrangement of FIG. 8 and 9 comprise input and output means. Thus the outer coils such as coils 106 may be considered as motor coils in the manner of the coils of the tripoles discussed above, while the inner coils, such as coil 111, may be employed as inputs or sensors to sense the exterior or opposing magnetic field of the field generator establishing the principal magnetic field with which the levitator interacts. Sensing of this exterior magnetic field provides control capabilities particularly advantageous for certain applications of the present invention. It is also noted that the input coils can derive electrical power from an external magnetic field to thereby become an auxiliary electrical generator.

Figure 10:
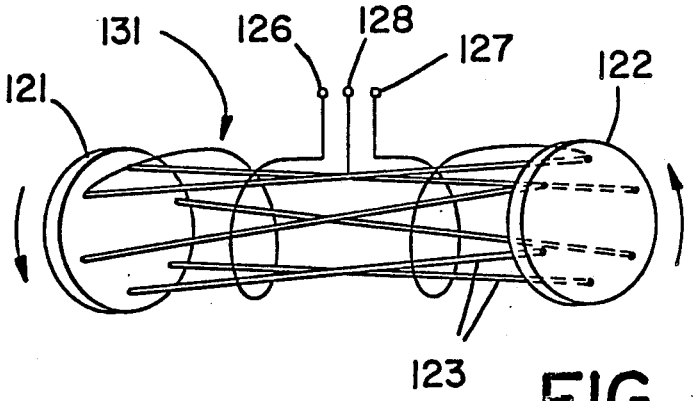
FIG. 10 is a partial schematic illustration of a further odd pole electric magnet structure.
Figure 11:
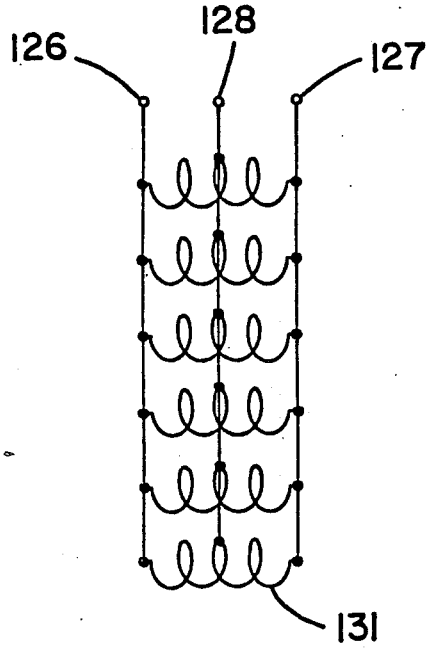
FIG. 11 is a wiring diagram of the electromagnet of FIG. 10.

An advantageous manner of forming a tripole is illustrated in FIG. 10 with the electrical circuitry thereof shown in FIG. 11. A pair of insulating discs 121 and 122 are space apart and connected by a plurality of, such as six, metal rods 123. Upon this structure, there are wound insulated wires to form coils and the structure upon which the coils are wound my be varied from cylindrical to a pair of hyperbolic horns by rotating the insulating discs 121 and 122 relative to each other. As illustrated in FIG. 10, the discs have been rotated slightly in order to indicate the variations from cylindrical. A number of single turn coil sections are wound on the rods 123 with the adjacent ends thereof exteriorly tapped as indicated at 126 and 127 and the outer coil ends connected to opposite ends of the same metal rod connected to a common terminal 128, again as shown in FIG. 10. A plurality, such as six, double coil windings as described above may be provided upon the structure with the inner ends of each coil section connected to a rod and, in fact, all of the rods may be electrically connected together at the center.

The arrangement described above, and generally illustrated in FIG. 10, will be seen to provide a plurality of parallel coils with a common center tap, as shown in FIG. 11. The coil 131 shown in FIG. 10 comprises only one of the plurality of parallel connect coils having a common center tap 128. This arrangement provides for parallel energization of a plurality of coils in a controllable manner for maximizing current flow through the coils for any level of electrical power input.

Figure 12:
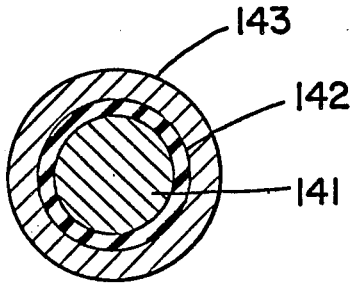
FIG. 12 is an enlarged cross sectional view of coil wire with an impedance matching coating thereon.

It has been noted above that impedance matching between the system of the flight unit and the opposing of surrounding magnetic field is advantageous. In FIG. 12, there is an enlarged section of a coil wire 141 having an insulating coating 142 thereabout with a coating 143 about the insulation. This coating may be formed of a material having a magnetic permeability that is larger than that of the wire 141, but smaller than that of the field generator establishing the field within which the unit is disposed. The permeability of the coating 143 should be also be close to the permeability of the medium within which the coil is disposed.

The present invention has been described above primarily with respect to movement of the levitator hereof in an artificially generated external magnetic field, however, it is noted that the levitator is also applicable to movement in the earth's magnetic field. In connection with this application of the present invention, it is advantageous to note certain theoretical considerations particularly with regard to types of magnetic fields and forces of interacation therebetween, as well as coupling between such fields. There follows a brief discussion of applicable theoretical considerations without any attempt to prove the known force laws identified therein.

When magnets interact with each other forces exist between them. Almost all magneto mechanical systems are composed of cylindrical magnets, the electromagnets being wound along the circumference as a helix, to generate dipole fields, herein termed "poloidal" fields. The forces are calculated with the Lorentz force law where the external field, the current in the winding and the force of the interaction with the external field all are perpendicular to each other. Other magneto mechanical systems can be composed of toroidal magnets, the electromagnets being wound along the circumference of the cross section of the torus. The forces can be calculated with the Ampere-Neumann force law where the external field, the current in the winding and the force of interaction with an external magnetic field all are parallel to each other.

Cylindrical windings achieve full coupling in a radial external field and toriodal windings achieve full coupling in an axial external field. In a cylindrical winding, the magnetic field is poloidal and the vector potential field is toroidal. In a toroidal winding, the magnetic field is toroidal and the vector potential field is poloidal. Poloidal fields generate forces of interaction when they couple and toroidal fields do not.

A cylindrical winding can be viewed as having a bobbin like a collapsed tire inner tube which can be "blown up" (topologically deformed) to become a torus. A toroidal winding can be viewed as having a bobbin like an inflated tire inner tube which can be "collapsed" (topologically deformed) to become a cylinder.

If the current in a wire loop is considered to be in a 3D space, the magnetic field around the wire is the vector curl of the current and exists some further dimension that might be considered as in 4D space. If the magnetic field around the wire is considered to be in 4D space the vector potential field around the magnetic field is the vector curl of the magnetic field and exists some further dimension that might be considered as in 5D space. Many more fields are nested in fields of higher dimensionality but only two are known to demonstrate macroscopic forces of interaction, magnetic fields via many common linear and rotational motors and vector potential fields.

From the foregoing, it has been determined that controlled linear movement of a levitator in the earth's magnetic field, for example, requires a high real coupling efficiency and is in fact dependent upon the gradient of the vector potential field of the levitator. In accordance with the present invention, the turns of the tripole winding hereof are wound perpendicularly to the circumference thereof around the length of a bobbin rather than winding same around the circumference thereof in order to radically improved the efficiency of coupling of a tripole to the parallel lines of force of the external magnetic field of the earth. Forceful interaction with the earth's magnetic field that accelerates the levitator is coupled primarily through the vector potential fields of the levitator winding and follows the Ampere-Neumann longitudinal electrodynamic force law, as noted, for example at Page 311 of Nature, Vol. 95, Jan. 28, 1982.

Figure 13:
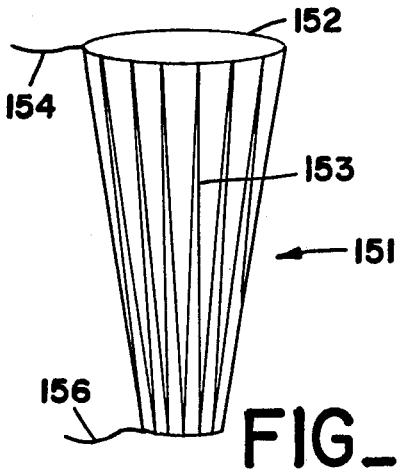
FIG. 13 and 14 illustrate longitudinally wounds toroidal windings that are employed in a tripole for full coupling with a surrounding magnetic field having substantially parallel lines of forces as in the earth's magnetic field.

There is illustrated in FIG. 13 an improved electrical winding or coil 151 which may, for example, be "wound" upon a frustoconical form 152 having a hollow interior. An insulated electrical conductor 153 is "wound" upon the form 152 by attaching the conductor to the exterior of the form in elongated V-shaped paths extending between the ends of the form, as illustrated. The winding conductor 153 will thus be seen to extend back and forth between the ends of the coil or winding 151 with electrical conductors 154 and 156 extending from opposite ends of same for electrical energization of the winding. It will be seen that this winding or coil 151 exhibits the magnetic characteristics of a toroidal coil wherein the surrounding magnetic field is toroidal but the vector potential field is poloidal. Thus the magnetic field of the winding 151 will generate forces of interaction is a surrounding external magnetic such as the magnetic field of the earth. It is in fact the vector potential field of the energized winding 151 which couples with the earth's field to generate forces of interaction with a high degree of coupling between such fields.

Figure 14:
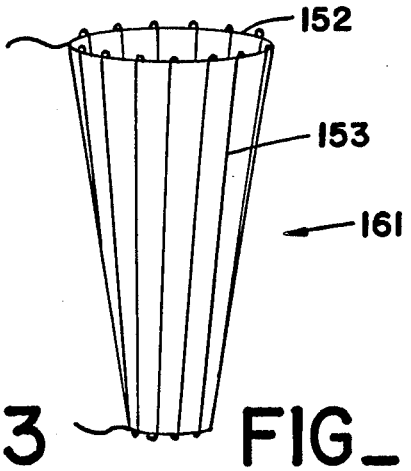

The winding or coil of FIG. 13 may be alternatively formed as illustrated in FIG. 14 wherein the same or similar coil form 152 is provided, and the insulated conductor 153 is wound longitudinally about the form 152 with alternate turns exteriorly and interiorly of the form. It will be seen that the winding of FIG. 14 is substantially the equivalent of the winding of FIG. 13 in so far as magnetic properties are concerned.

Figure 15:
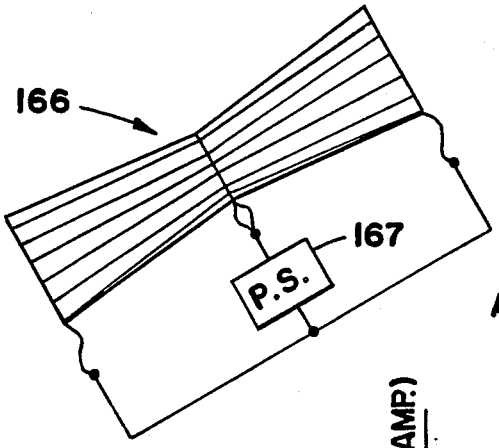
FIG. 15 is an illustration of a tripole magnet employing the winding of FIGS. of 13 or 14 and illustrating energization thereof.

In accordance with the present invention two coils 151 or 161 are disposed in axial alignment with the small ends of each contiguous to form a tripole magnet structure 166, as illustrated in FIG. 15. The tripole may be energized by a controllable power supply 167 connected between the center of the tripole and the ends thereof. Energization of the tripole 166 to pass current through the windings thereof, as for example, from the center to the outer ends will produce a surrounding magnetic field having a differential field strength between the outer ends and the center of the tripole. This then satisfies the criteria set forth above for a tripole in accordance with the present invention, however, this particular tripole produces a toroidal magnetic field having a vector potential field that is poloidal and which generates forces of interaction with the surrounding dipole magnetic field when coupled therewith. This particular tripole magnet structure thus couples with high efficiency to the poloidal or dipole external magnetic field, i.e., one having parallel or substantially parallel lines of force, as is found in the earth's magnetic field.

The tripole magnet 166 of FIG. 15 may be employed directly for levitation or may combined in orthogonal arrangement with a another tripole to thus produce a controllable levitating structure of the same general type as described above and illustrated, for example, on FIG. 3. Higher order odd pole magnets may also be constructed from this basic building block as discussed above.

Figure 16:
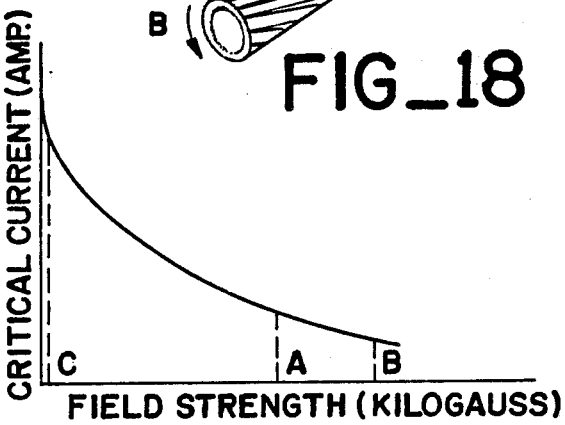
FIG. 16 is a flux curve.

It will be appreciated that levitation for any substantial distance in the earth's magentic field is best accomplished without physical connection of the levitator to the ground or power supply means that may be located thereat. This can be accomplished by providing the levitator itself with a self contained power supply. Such a power supply may energize the windings of the levitator magnets with electrical energy stored in the windings. Considering this matter some what further, it is noted that the force, F, applied to a current carrying conductor in a magnetic field, B, is proportional to Bli, wherein 1 is the length of the conductor and i is current flowing through the conductor. Interaction with the relatively weak earth's magnetic field produces levitation and motion of the levitator hereof may best be accomplished by causing a vary large current to flow through the windings of the electromagnet hereof. Reference is made in this respect to FIG. 16 illustrating a curve of critical current versus magnetic field strength. Commonly motors are operated in the range A to B in the figure, wherein the current is relatively low and the field strength is relatively high. Inasmuch as the field strength of the earth's magnetic field is known to be quite low, the present invention operates upon an entirely different portion of the curve, as indicated, for example, at C thereon wherein a very large current is employed.

The current carrying capacity of electrical conductors is known to be related to the resistance thereof, and in order to achieve truly high current density, the present invention employs conductors having extremely small or substantially zero resistance, i.e., superconductors. One known superconductor of use here is niobium-titanium that may comprise an alloy containing 48% titanium and a superconductor so comprised preferably includes copper clading of full annealed copper. Superconducting properties of alloys are generally considered to be attainable only at very reduced temperatures although recent research indicates that some types of conductors may exhibit superconducting properties at higher temperatures. A cryostat may be employed to provided the requisite low temperature for achieving superconductivity of the windings thereof, and in this respect reference is made to an article entitled "A flying superconducting magnet and cryostat for magnetic suspension for wind-tunnel models" by Britcher, Goodyear, Scurlock and Wu appearing at page 185 of Cryogenics, April 1984. The boiling of liquid helimum will reduce the temperature of the windings to the point where the resistance thereof approaches zero so that extremely high current flow is possible through the windings by discharge of energy stored in windings, for example.

Figure 17:
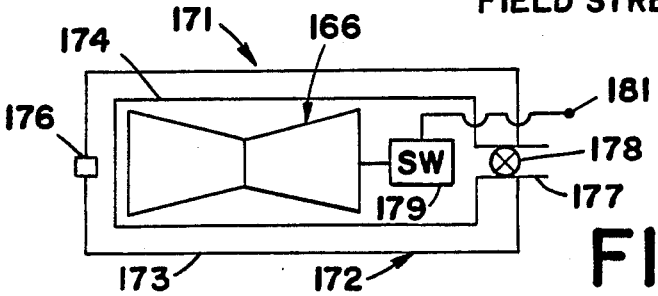
FIG. 17 is a schematic illustration of a cryostat and a tripole magnetic in accordance with the present invention and comprising a levitator in the magnetic field of the earth.

There is schematically illustrated in FIG. 17 a levitator 171 incorporating a tripole magnet or tripole magnet 166 and cryostat 172. The cryostat includes an outer insulated envelope 173 providing heat insulating for the interior thereof and an interior shell 174 mounting the tripole magnet 166. A vacuum connection 176 is provided to evacuate the interior of the envelope and shell, and a fill and vent line 177 extends exteriorly of the rear of the envelope with a valve 178 therein. A switch 179 is electrically connected between the terminals of the tripole 166 and terminals 181 exteriorly of the envelope 173. Electrical connections are only schematically illustrated in FIG. 17.

In accordance with conventional practice the cryostat 172 is first evacuated and then charged with liquid helium through the inlet/vent line 177 via the value 178. The tripole 166 is then charged by an external power supply through the switch 179 which is connected across the windings of the tripole to prevent shorting of the power supply during charging. After disconnection of the power supply, the valve 178 is opened to vent the liquid helium to the atmosphere exteriorly of the cryostat so as to bring the temperature therein to a very low temperature by boiling of the liquid helium. Actuation of the switch 179 then causes a circulating current to flow through the windings of the tripole 166 against substantially zero resistance so that this current then persists to produce the above noted magnetic field about the tripole 166 which couples with the earth's magnetic field to cause forces of interaction which move or levitate the levitator 171. It will, of course, be appreciated that this levitator 171 may, and preferably does, include a pair of orthagonal disposed tripoles 166, however, only a single tripole is illustrated in FIG. 17 for easy of illustration and description.

The levitator of FIG. 17 may, for example, comprise a small space vehicle with the outer shell being formed of aluminum sheet having dimension of ten inches in length by two and half inches in diameter with the motor comprising a pair of tripolel windings of niobium-titanium wire having a one inch diameter and two inch length. With the structure weighing one ounce and the motor weighing three ounces, a refrigerant in the form of two ounces of liquid helium may be provided therein to provide a total weight at lift off of 6 ounces. Such a unit may have a total thrust at lift off of 9 ounces with an altitude at burnout of three miles and a velocity of twenty-five hundreds miles per hour at such burnout. Steering of such a unit may be accomplished by controlled passage of some current through an orthogonal winding of aluminum wire, for example, which exhibits some resistance at the temperature of operation of the unit so as to provide desired lateral forces of interaction with the earth's magnetic field.

Figure 18:
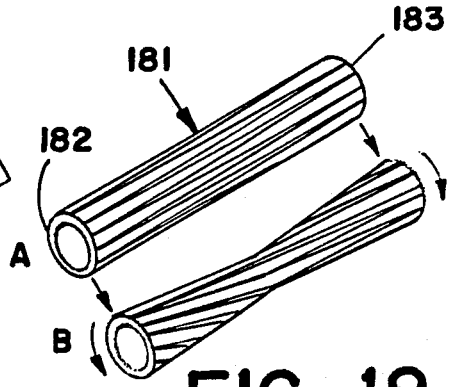

The tripole magnet field hereof with longitudinally wound torodial windings as shown, for example, in FIG. 13, may also be formed by placing the conductors upon a deformable form that may be similar to the structure of FIG. 10 wherein the ends of the winds are capable of being rotated. A winding 181 may thus be formed as elongated turns in a cylindrical shape, as shown at A of FIG. 18. End discs or rings 182 and 183 are then controllably rotated in opposite directions to twist the winding 181 into a pair of frusto-conical shapes having contiguous small ends, as shown at B of FIG. 18. Appropriate electrical connections are made to the windings as noted above and the tripole electromagnet may thus be readily controlled as to taper of the windings for establishing a desired differential field strengths between the center and ends thereof.

It will be appreciated that there has been described above a free flying magnetic levitator having extended capabilities not only for producing usable forces of interaction with generated electrical fields but also with the earth's magnetic field. It is further noted that the present invention particularly as described in the above noted example of a levitator in accordance herewith may be scaled up to larger sizes with increased efficiencies and the capabilities of lifting substantial pay loads. It is also noted that the toroidal winding of FIGS. 13 and 14 may be employed in each of the configurations described and illustrated for the winding of FIG. 2, for example. Thus the present invention does provide a material advancement in field of space vehicles whether such space be considered as the space above a desktop or as the space about the earth, and beyond.

Although the present invention has been described above with respect to the particular preferred embodiments and in connection with a particular principle magnetic fields source with which the levitator interacts, it is not intended to limit the present invention to the terms of description or details of illustrations for it will be apparent to those skilled in the art that many variations and modifications are possible within the spirit and scope of the present invention.

What is claimed is:

1. A free flying magnetic levitator adapted for disposition in an external surrounding dipole magnetic field having substantially parallel lines of force and comprising at least a first pair of axially elongated toroidally wound magnet windings with each having a tapered configuration from a small diameter and to an outer large diameter end and said windings being disposed axially of each other with the small diameter ends contiguous to form a tripole magnet, and means for controllably energizing said magnetic windings by current flowing between the small diameter ends and the large diameter ends to establish a magnetic field having like magnetic poles at the outer large diameter ends whereby the energized pair of magnet windings produce a tripole magnetic field having a dipole vector potential field generating forces of interaction with the external surrounding the dipole magnetic field for moving the levitator in the surrounding dipole magnetic field.

2. The levitator of claim 1 further defined by a second pair of tapered elongated toroidal magnet windings disposed in axial alignment with the small diameter ends thereof contiguous to form a second tripole magnet and the axis of said second pair of magnet windings being disposed perpendicularly to the axis of said first pair of magnet windings, and means for controllably energizing said second pair of magnet windings for controlling motion of said levitator in said surrounding dipole magnetic field.

3. The levitator of claim 1 further defined by said magnet windings each comprising a frusto-conical form having an insulated conductor disposed upon an outer surface thereof and extending back and forth between the ends thereof about the circumference of the form and having electrical connections to opposite ends of the conductor at opposite ends of the form for electrical energization to generate a toroidal magnetic field about said windings.

4. The levitator of claim 1 further defined by each of said magnet windings comprising a hollow frusto-conical form and an insulated conductor wound longitudinally of said form about the inner and outer surfaces thereof in successive turns whereby energization of said windings produces a toroidal magnetic field thereabout having a differential field strength between ends of said form.

5. The levitator of claim 1 further defined by an envelope about said windings, liquid helium disposed in said envelope for boiling out of a vent of said envelope to maintain a very low temperature interiorly thereof, at least one pair of said magnet windings being comprised of a superconducting material having substantially zero resistance at said low temperature, and means circulating a very large current through said windings for maximizing the magnetic force of interaction with said surrounding magnetic field.

6. The levitator of claim 5 further defined by a second pair of like elongated toroidally wound windings in axial alignment with tapered configurations and contiguous small ends, said second pair of windings being formed of insulated conductors that exhibit electrical resistance at said low temperature, said second pair of windings being disposed orthogonally to said first pair of windings, and means for controllably energizing said second pair of windings for controlling motion of said levitator in said surrounding magnetic field.

7. The levitator of claim 2 further defined by said means for controllably energizing said windings comprising an amplifier connected across each of said windings, a potentiometer connected across the input of each of said amplifiers to control current through each of said windings separately, a magnet control potentiometer connected to said amplifiers through the potentiometers thereof to vary the relative current through said first and second pairs of magnet windings, and a polarity control potentiometer connected across a power source and connected to said magnet control potentiometer for controlling the polarity of current flow through said first and second pairs of magnet windings.

8. The levitator of claim 7 further defined by a plurality of signal generators with each having control means and connected to said electromagnets for modulating currents passed through said magnet windings.

9. The levitator of claim 1 further defined by the windings of said tripole magnet having the tapered configurations thereof conforming to hyperbolic horns with contiguous throats.

10. The levitator of claim 1 further defined by said windings being formed of insulated conductors having a coating thereon with a magnetic permeability intermediate the permeability of the windings and the permeability of a source of said magnetic field.

11. The levitator of claim 10 further defined by said coating also having a magnetic permeability near that of a medium about said levitator.

12. The levitator of claim 1 further defined by said magnet windings comprising a pentapole magnet having a plurality of four tapered winding sections with the large diameter ends thereof disposed substantially upon separate surfaces of a tetrahedron and the small diameter ends connected together at the center of said tetrahedron and said means energizing said windings connected to pass current through each of said windings to establish like poles at the center of said tetrahedron.

13. The levitator of claim 1 further defined by said pair of magnet windings being disposed upon an elongated cylinder having means for rotating the ends thereof to twist the windings into a pair of frusto-conical sections having contiguous small ends for controlling the taper of said windings from the large to the small ends thereof.

* * * * *